US005159145A

United States Patent [19]

Carisella et al.

[11] Patent Number: 5,159,145

[45] Date of Patent: Oct. 27, 1992

[54] METHODS AND APPARATUS FOR DISARMING AND ARMING WELL BORE EXPLOSIVE TOOLS

[75] Inventors: James V. Carisella, 7524 Garnet, New Orleans, La. 70124; Robert B. Cook, Mandeville, La.

[73] Assignee: James V. Carisella, New Orleans, La.

[21] Appl. No.: 750,830

[22] Filed: Aug. 27, 1991

[51] Int. Cl.[5] ..... F42C 15/00; E21B 43/116

[52] U.S. Cl. ..... 89/1.15; 102/222; 175/4.54; 175/4.56

[58] Field of Search ..... 89/1.15; 102/202.1, 102/222; 175/4.54, 4.56

[56] References Cited

U.S. PATENT DOCUMENTS

| | | | |
|---|---|---|---|
| 2,084,218 | 6/1937 | Rémondy | 102/222 |
| 2,314,891 | 3/1943 | Moore | 102/222 |
| 2,724,333 | 11/1955 | Seavey | 102/310 |
| 2,925,775 | 2/1960 | McKee | 175/4.56 |
| 3,099,215 | 7/1963 | Brockway | 102/416 |
| 3,406,630 | 10/1968 | Müller | 102/275 |
| 3,774,541 | 11/1973 | Bratton | 102/275.1 |
| 4,011,815 | 10/1975 | Garcia | 175/4.51 |
| 4,577,544 | 3/1986 | Lee | 89/1.14 |
| 5,070,788 | 12/1991 | Carisella et al. | 89/1.15 |

*Primary Examiner*—David H. Brown
*Attorney, Agent, or Firm*—Archambeau, Jr. E. R.

[57] ABSTRACT

In the representative embodiments of the several methods and apparatus of the invention, a barrier formed of a low-temperature fusible metal alloy having a selected melting point is arranged between a receptor explosive and a typical electrically-initiated detonator enclosed in an explosion-proof housing for blocking the transmission of detonation forces from the detonator to the receptor explosive until the detonator has been subjected to well bore temperatures which are greater than the melting point of the fusible alloy. By selecting a fusible metal alloy which has a melting point less than the known temperatures of the well bore fluids, when the tool is exposed to those elevated temperatures, the barrier will be predictably transformed to its liquid state thereby allowing the liquid alloy to flow to a non-blocking position away from the detonation path of the donor explosive. Means are provided to return the fluent fusible metal alloy to its initial detonation-blocking position between the explosives so that the fusible metal alloy will again provide an effective barrier for reliably preventing the detonation of the receptor explosive as the well tool is subsequently recovered from the well bore.

37 Claims, 3 Drawing Sheets

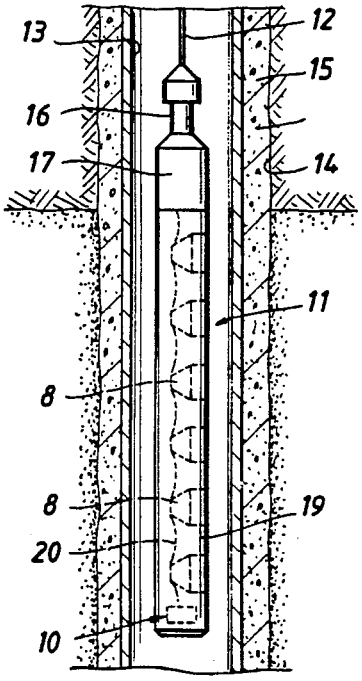
FIG. 1
FIG. 2
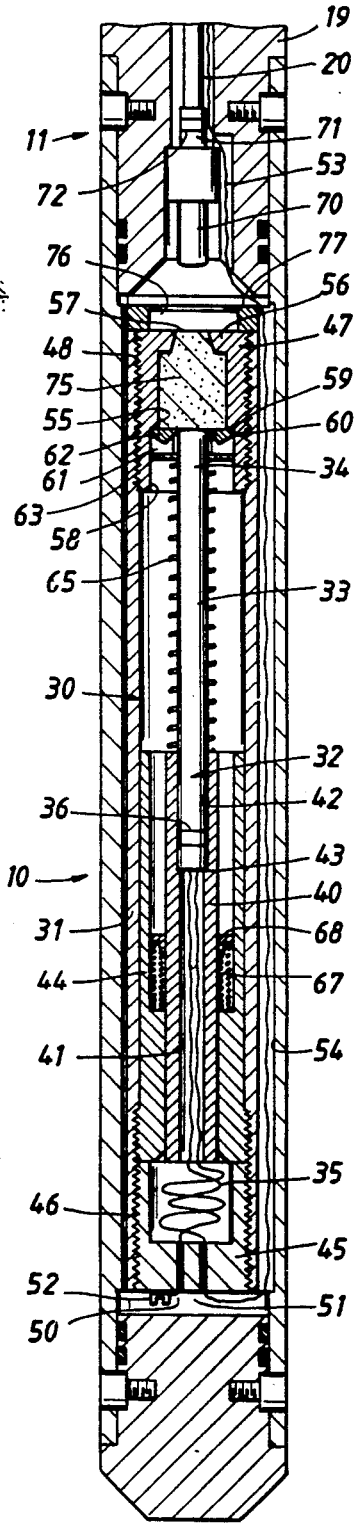
FIG. 3
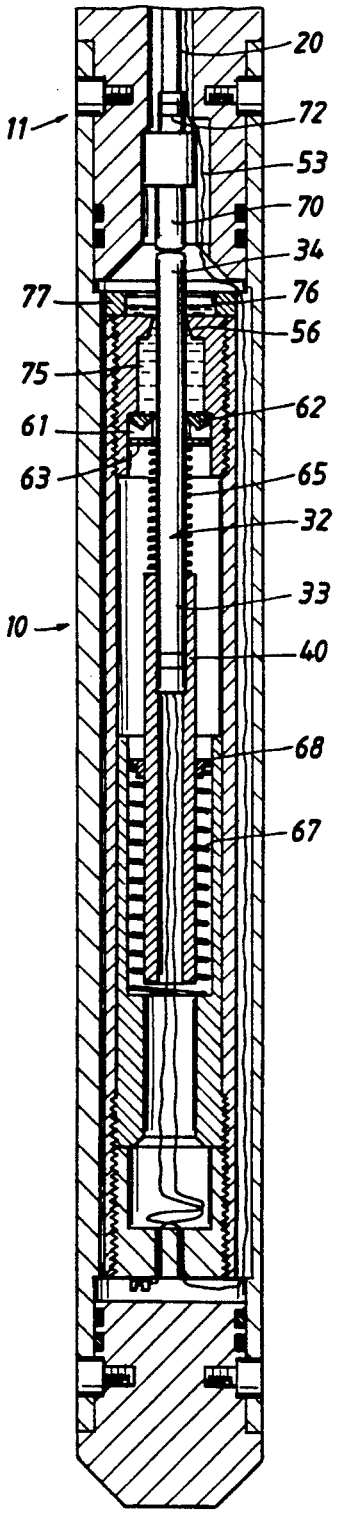

METHODS AND APPARATUS FOR DISARMING AND ARMING WELL BORE EXPLOSIVE TOOLS

BACKGROUND OF THE INVENTION

Electrically-initiated or so-called "electric" detonators are commonly employed for actuating one or more explosive devices on various types of well bore tools such as perforating guns, explosive cutting tools, chemical tubing cutters and explosive backoff tools. These tools are typically dependently supported in a well bore by a so-called "wireline" or suspension cable with electrical conductors connected to a surface power source. The detonators that are typically used with these wireline tools with explosive devices are usually comprised of a fluid-tight hollow shell encapsulating an igniter charge (such as black powder or an ignition bead) that is disposed around an electrical bridge wire positioned adjacent to a primer explosive charge such as lead azide that is set off when electric current is passed through the bridge wire. Some detonators may also include a booster charge of a more-powerful, less-sensitive secondary explosive (such as RDX or PETN) which is cooperatively arranged in the shell to be detonated by the less-powerful primer explosive charge. These detonates are typically coupled to an explosive detonating cord positioned in detonating proximity of the one or more explosive charges carried by the wireline tool.

It is, of course, imperative that none of these explosive devices are inadvertently actuated while the well bore tool is at the surface to prevent fatalities and injuries to personnel as well as avoid damaging nearby equipment. One common cause of the inadvertent actuation of wireline well tools employing electric detonators is the careless application of power to the conductors in the cable after the detonator has been electrically connected to the conductors. To minimize that risk, key-operated switches are frequently used for disabling the surface power source until the well tool has been lowered to a safe depth in the well bore. Another common safety technique is to enclose the detonator in a so-called "safety tube" until the detonator is installed in the tool. It must also be realized that should the wireline tool be returned to the surface without its explosive charges having been fired, this significant hazard to nearby personnel and equipment will again reappear while the detonator is being removed from the tool body, disconnected from the detonating cord and the cable conductors, and returned to a safety tube or some other suitable explosion-resistant container.

These safety procedures will, of course, greatly reduce the chances that some human error will be responsible for inadvertent actuation of one of these well tools with explosive devices while it is located at the surface. Nevertheless, a major source of the inadvertent actuation of these typical wireline tools is that the electric detonators commonly used in these tools are quite susceptible to strong electromagnetic fields. Another source of inadvertent actuation of these detonators is the unpredictable presence of so-called "stray voltages" which ay sporadically appear in the structural members of the drilling platform. Such stray voltages are not ordinarily present; but these voltages are often created by power generators being used on the drilling rig as well as the cathodic protection systems used to counter galvanic corrosion cells that may be present at various locations in the structure. Lightning may also set off these detonators. At times, hazardous voltage differences may also be developed between the wellhead, the structure of the drilling rig and the electrical equipment used to operate the well tools. A recent SPE technical paper which was authored by K. B. Huber and titled "Safe Perforating Unaffected by Radio and Electric Power" (SPE 20635 presented Sep. 22–26, 1990) give an analysis of the hazards and the current state of the prior art of safeguarding wireline tools with explosive devices such as various types of perforators.

Because of these potential hazards that exist once a typical wireline explosive tool has been armed, many proposals have been made heretofore for appropriate safeguards and precautions to be taken while these tools are at the surface. For instance, when a perforating gun is being prepared for lowering into a wellbore, in keeping with the susceptibility of typical electric detonators to strong electromagnetic fields it is prudent to maintain strict radio silence in the vicinity. Ordinarily temporary restrictions on nearby radio transmissions will not represent a significant problem on a land rig. On the other hand, when a wireline tool with explosives is being used on a drilling vessel or an offshore platform, it is a common practice to at least restrict, if not totally prohibit, radio and radar transmissions from the platform and any surface vessels and helicopters in the vicinity of the operation. It may be necessary to postpone welding operations on the rig or platform also since welding machines develop currents in the structure that may initiate a sensitive electric detonator in an unprotected explosive tool that is located at the surface.

It will, of course, be recognized that an inordinate amount of time is lost when a wireline explosive tool with an electrical detonator is being prepared for operation on an offshore platform is being prepared since operations unrelated to the particular operation must be curtailed. For example, movements of personnel and equipment by helicopters and surface vessels must be limited to avoid radio and radar transmissions which might set off the detonator. Thus, when an operation with a wireline tool carrying explosives is being considered, the relative priorities of the various operations must be taken into account to decide which of these activities must be curtailed or even suspended in favor of higher-priority tasks. These problems relating to one offshore rig may similarly affect operations on nearby rigs. Accordingly, where there are a large number of these hazardous operations in a limited geographical area, it will be necessary to coordinate the various operations in that field to at least minimize the obvious restrictive effects on those operations.

In view of these problems, various proposals have been made heretofore to disarm these electrical detonators by temporarily interrupting the explosive train between the detonator and the other explosives in the tool. It is, of course, well known that a barrier formed of a dense substance, such as a rubber or metal plug, positioned between the donor and receptor charges in a typical detonator will attenuate the detonation forces of the donor explosive sufficiently to reliably block the detonation of the receptor charge. For example, some commercial detonators are sold with rubber plugs disposed in the fluid-disabling ports that communicate to the empty space between the adjacent charges. This same principle is, of course, employed with the barriers that are disclosed in U.S. Pat. No. 4,314,614 as well as in FIG. 7 of U.S. Pat. No. 4,011,815. U.S. Pat. No. 4,523,650 discloses a disarming device employing a rotatable barrier that is initially positioned to interpose a solid detonation-blocking wall between the donor and receptor explosives in the detonator until the perforator is ready to be lowered into the well bore. To arm that detonator, the barrier is rotated so as to align a booster explosive in the barrier with the spatially-arranged donor and receptor explosives. With any of these prior-art safearming devices, it is, of course, critical to either completely remove or else reposition the temporary barrier before the perforator is lowered into a well bore so that it will thereafter be free to operate. Thus, once any of these temporary barriers has been repositioned or removed from the perforating gun, the detonator in the perforator is subject to being inadvertently detonated by any of the extraneous hazards discussed above.

A new electronic detonating system described in the above-identified SPE paper includes an electrically-actuated initiator assembly which includes an encapsulated pellet of a secondary explosive that is disposed around a foil-covered metallic bridge. The initiator assembly is spatially disposed from a secondary explosive booster and isolated therefrom by a thin wall or metal partition. The initiator assembly is initially disarmed by means of a removable safety barrier which is temporarily placed in the space between the two charges until the perforator is ready to be lowered into the well bore. The detonating system further includes an electronic cartridge arranged for supplying a sudden burst of electrical energy to the foil-covered bridge to instantaneously vaporize the bridge for forcibly driving a portion of the foil bridge against the secondary explosive pellet with sufficient force to set off the pellet. The detonation of this secondary pellet will, inn turn, cause a plug or so-called "flyer" to be sheared out of the end partition of the initiator assembly and forcibly driven across the space between the charges to strike the adjacent end of the second explosive booster charge with sufficient force to sequentially induce high-order detonations of the booster charge and a detonating cord that is coupled thereto. It will, of course, be appreciated that since this detonating system does not have any primary explosives, this system is not as susceptible to extraneous electrical energy as are the other prior-art detonating systems described above. Nevertheless, it must be recognized that since an electronic detonating system of this nature is quite expensive, cost considerations may restrict the use of these systems to perforating operations in high-risk locations.

OBJECTS OF THE INVENTION

Accordingly, it is an object of the invention to provide new and improved methods and apparatus for selectively enabling and disabling wireline well tools carrying explosive charges which are selectively actuated by electrical detonators.

It is a further object of the present invention to provide new and improved selectively-actuated explosive detonators that are safeguarded from being inadvertently detonated by spurious electrical energy emanating from extraneous stray currents or nearby radio or radar signals.

It is another object of the invention to provide new and improved methods and apparatus for enabling explosively-actuated wireline tools only after they have been exposed to predicted well temperatures for an extended time period as well as then predictably deactivating the tools if they are returned to the surface without having been actuated.

SUMMARY OF THE INVENTION

In one manner of carrying out the new and improved methods and apparatus of the present invention, a detonator is arranged to include a donor explosive enclosed in an explosion-resistant detonator case. An explosion-resistant barrier is formed of a low-temperature fusible metal alloy having a selected melting point and arranged between the explosives to isolate the donor explosive in the detonator case so long as the barrier is not subjected to a temperature greater than the melting point of the alloy. The detonator includes means operable for bringing the explosives into detonating proximity with one another for arming the detonator only so long as the barrier is maintained in its liquefied state by exposure to well bore temperatures greater than the melting point of the alloy and for then separating the explosives to selectively disarm the detonator when the detonator is exposed to well bore temperatures lower than the melting point of the alloy and the barrier resolidifies for isolating the donor explosive a second time in the explosion-resistant case.

BRIEF DESCRIPTION OF THE DRAWINGS

The novel features of the present invention are set forth with particularity in the appended claims. The invention along with still other objects and additional advantages thereof may be best understood by way of exemplary methods and apparatus which employ the principles of the invention as best illustrated in the accompanying drawings in which:

FIG. 1 schematically depicts a wireline perforator having a detonating system cooperatively arranged in accordance with the principles of the invention to selectively disable and enable the wireline perforator during the practice of the methods of the invention;

FIG. 2 is an elevational view of a preferred embodiment of a new and improved selectively-disabled detonating system for use in the wireline perforator illustrated in FIG. 1 and depicting the detonating system while it is initially disabled;

FIG. 3 is a elevational view similar to FIG. 2 depicting the detonating system as the system will appear when it has been selectively armed for subsequent actuation from the surface;

DESCRIPTION OF A PREFERRED EMBODIMENT OF THE INVENTION

Figure 4:
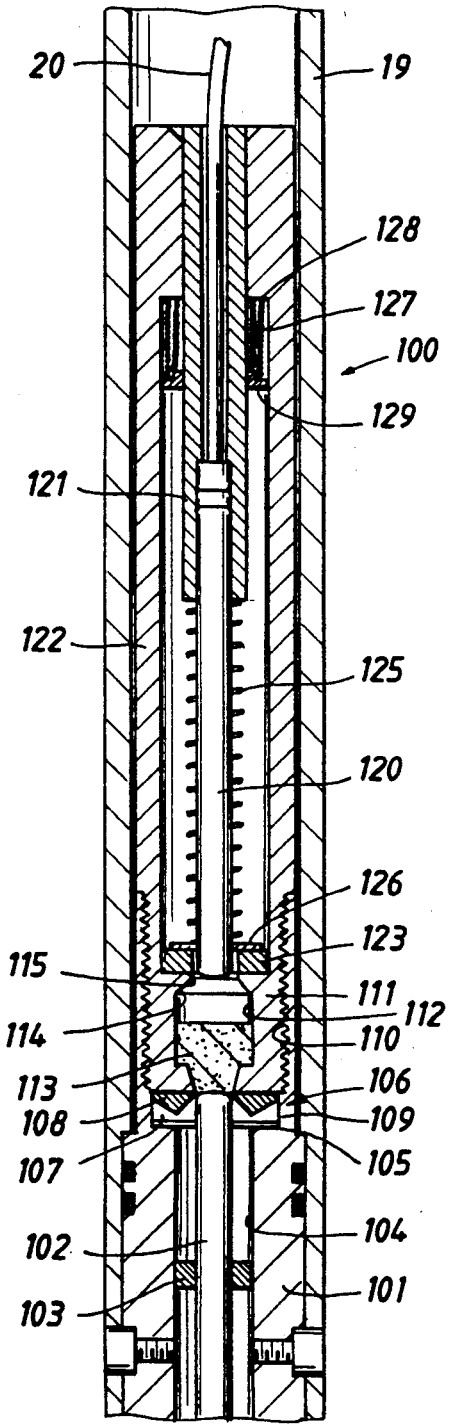
FIGS. 4 and 5 are elevational view of an alternative embodiment of a new and improved selectively-disabled detonating system incorporating the principles of the invention that may also be used for selectively arming the perforator illustrated in FIG. 1, with FIGS. 4 and 5 respectively depicting the system in a disarmed state and then after the detonating system has been armed for selective operation from the surface.

Turning now to FIG. 1, as indicated generally at 10, a new and improved detonating system arranged in accordance with the principles of the invention is shown as this detonating system would be utilized for reliably controlling from the surface the operation of a typical wireline perforator as shown generally at 11. It is to be understood, however, that the new and improved detonating system 10 of the present invention is not necessarily restricted to use with only wireline perforators; but that this unique detonating system can also be employed with other wireline tools with explosive charges which are to be selectively actuated by electric detonators without departing from the intended scope of the invention.

As is typical, the perforator 11 depicted in FIG. 1 is dependently connected to the lower end of a conventional armored suspension cable 12 with one or more electrical conductors which is spooled on a winch (not illustrated in the drawings) at the surface and selectively operated for moving the perforating gun through a casing 13 secured within a borehole 14 by a column of cement 15. The perforating gun 11 is coupled to the lower end of the so-called "wireline cable" 12 by means of a rope socket 16 which facilitates the connection of the electrical conductors of the cable to the new and improved selectively-armed detonator 10 of the present invention. As is typical, the perforating gun 11 preferably includes a collar locator 17 connected by way of the conductors in the cable 12 to appropriate surface instrumentation (not illustrated in the drawings) for providing characteristic signals representative of the depth location of the gun as it is successively moved past the collars in the casing string 13. As further depicted in FIG. 1, the perforating gun 11 is a typical hollow-carrier perforator cooperatively carrying a plurality of shaped explosive charges 18 mounted at spaced intervals in an elongated fluid-tight tubular body or so-called "carrier" 19. To selectively detonate the charges 18, the lower end of a typical detonating cord 20 of a suitable secondary explosive, such as RDX of PETN, is operatively coupled to the detonating system 10 of the invention; and the cord is extended upwardly through the carrier 19 and positioned so as to be in detonating proximity of each of the shaped charges.

Turning now to FIG. 2, a preferred embodiment of the new and improved detonating system 10 arranged in keeping with the principles of the present invention is shown as being arranged in the perforator carrier 19. As depicted, the new and improved detonating system 10 includes enclosure means 30 such as a hollow metal container 31 which is mounted in an upright position in the lower end of the perforator carrier 19 adjacent to the lower end of the detonating cord 20. It will, of course, be appreciated that even though the enclosed container 31 provides a measure of shielding for the detonator 32 against the electromagnetic fields from nearby radio or radar transmissions, there is still a risk that the detonator will be inadvertently detonated by spurious electrical energy picked up by the suspension cable 12 (FIG. 1) or from other sources. Accordingly, the tubular enclosure 31 is preferably fabricated of a high-strength steel tube with a wall thickness sufficient to reliably and safely withstand the extreme explosive forces typically produced by an electric blasting cap or conventional electric detonator 32 (such as, for example, the E-128 or E-141 detonators currently offered for sale by DuPont).

Although various electric detonators can be alternatively employed without departing from the intended scope of the present invention, it will be appreciated that the electric detonator 32 will typically include a primer charge of lead azide or other primary explosive (not illustrated) and a booster charge of RDX or other suitable secondary explosive (not illustrated) which are serially arranged in an elongated, thin-walled tubular shell 33 shaped to define a closed end portion 34. Electrical leads 35 extending from the other end of the metal detonator shell 3 are connected to an electrical bridge wire (not illustrated) that is cooperatively arranged within the shell to set off an igniting explosive (not illustrated) disposed in the hollow shell in detonating proximity of the primer explosive charge. To protect the explosives enclosed in the hollow shell 33 from moisture, the electrical leads 35 are typically fluidly sealed in the detonator shell by a rubber plug (not illustrated) secured in the open end portion of the shell by means of one or more circumferential crimps as at 36.

The explosion-resistant enclosure means 30 further include means for supporting the electric detonator 32 for longitudinal movement in the container 31 between its retracted lower position depicted in FIG. 2 and an extended upper position depicted in FIG. 3. In the preferred embodiment of the enclosure means 30 of the present invention, an elongated tubular support 40 having a longitudinal bore 41 is slidably disposed within the container 31. To couple the tubular support 40 to the detonator 32, the upper end of the longitudinal bore 41 of the elongated support is counterbored, as at 42, and cooperatively sized to snugly receive the lower portion of the detonator shell 33. In this way, when the detonating system 10 of the present invention is assembled, the lower portion of the detonator shell may be readily inserted into the counterbore 42 and safely moved into the tubular support 40 until the lower end of the shell 33 is engaged on an upwardly-directed shoulder 43 defined by the lower end of the counterbore. As illustrated in FIG. 2, the electrical detonator leads 35 typically project out of the lower end of the detonator shell 33 are of sufficient length at the two leads may be readily passed on through the longitudinal bore 41 of the tubular support 40 and easily connected to the firing circuit of the perforator 11.

To facilitate the manufacture and assembly of the explosion-resistant enclosure means 30 of the invention, a tubular support guide 44 is coaxially mounted within the lower portion of the container 31 and supported at its lower end on an upwardly-facing annular shoulder defined by a threaded end plug 45 secured by mating internal threads 46 within the lower end of the explosion-proof container. An end plug 47 is similarly arranged within the upper end of the explosion-proof container 31 and secured therein by mating internal threads 48. During the final assembly of the detonating system 10, an epoxy adhesive is preferably applied to the mating threads 46 and 48 before the end plugs 45 and 47 are threadedly installed at the opposite ends of the longitudinal bore 41 for permanently bonding or securing the end plugs within the cylindrical container 31 to further ensure the integrity of the explosion-proof container.

One or two small holes, as at 50 and 51, are drilled through the end wall of the lower end plug 45 to provide wire passages by which the terminal portions of the electrical leads 35 for the detonator 32 can be passed extend outside of the explosion-proof container 31. As depicted in FIG. 2, the detonator leads 35 are typically connected into the firing circuit of the perforator 11 as, for example, by a grounding screw 52 in the lower end plug 45 and an elongated conductor 53 which is extended on upwardly into the carrier 19 by way of a wire passage 54 defined between the external wall of the explosion-resistant container 31 and the internal wall of the perforator carrier. As will be subsequently described in more detail, it should be noted that the holes 50 and 51 in the end wall of the lower end plug 45 are purposely made slightly larger than the detonator leads 35 for providing a pressure-communication path from the interior of the explosion-resistant container 31.

In keeping with the principles of the present invention, the upper end plug 47 is fabricated to provide a longitudinal passage which includes an enlarged-diameter chamber 55 in the mid-portion of the plug which is axially aligned with the tubular detonator support 40. The upper end of the enlarged chamber 55 in the end plug 47 is terminated, as indicated generally at 56, by upwardly-converging interior walls ending with the circular opening 57 in the upper end surface of the end plug that is cooperatively sized to be slightly larger than the outside diameter of the detonator shell 33. The lower part of the longitudinal passage through the upper end plug 47 is also counterbored to provide a downwardly-facing enlarged chamber 58 in the lower portion of the end plug which is slightly larger in diameter than the enlarged chamber 55 and defines a downwardly-facing shoulder 59 at the junction of these two chambers.

As indicated generally at 60 in FIG. 2, packing means are disposed in the enlarged-diameter chamber 58 in the lower portion of the upper end plug 47 and cooperatively arranged for providing a substantial sealing engagement around the upper end portion of the cylindrical detonator shell 33. In the new and improved detonating system 10, the packing means 60 preferably include an upwardly-facing chevron packing ring 61 of Teflon which is shaped to complementally receive a downwardly-facing frustoconical metal support ring 62. The lower face of the Teflon packing element is supported on the upper face of a flat annular washer 63 loosely disposed around the detonator shell 33 just below the interfitted annular sealing rings 61 and 62.

Biasing means, such as an elongated compression spring 65 coaxially mounted around the detonator shell 33 and moderately compressed between the lower face of the washer 63 and the upper end of the tubular support 40, are cooperatively arranged for urging the backup ring 62 upwardly against the annular shoulder 59 at the junction of the chambers 55 and 58 in the upper end plug 47. The biasing spring 65 also serves to impose a moderate downward force on the tubular detonator support member 40. As will be subsequently explained, the new and improved detonating system 10 of the present invention further includes biasing means such as a unique temperature-responsive actuator 67 cooperatively arranged within the explosion-responsive container 31 for urging the tubular detonator support 40 upwardly in relation to the container with a biasing force that becomes greater in response to increasing temperatures for countering the moderate constant downwardly-acting force provided by the spring 65.

In the preferred embodiment of the detonating system 10 of the present invention, this unique actuator 67 is disposed within the tubular support guide 44 and coaxially arranged around the tubular support 40 between the lower end of the support guide and an annular shoulder 68 that is press-fitted on the mid-portion of the tubular support. The temperature-responsive actuator 67 is movably arranged from its depicted lower position in response to increasing ambient temperatures. In its preferred embodiment, the actuator 67 is formed of a so-called "shape memory metal" having a "two-way memory" such as the alloys that are presently manufactured by Memory Metals Inc. of Stamford, Conn., and marketed under the trademark Memrytec. Complete descriptions of these Memrytec alloys and typical fabrication techniques are fully described in a technical article on page 13 of the July, 1984, issue of the periodical ROBOTICS AGE entitled: "Shape Memory Effect Alloys for Robotic Devices" as well as in a brochure put out by Memory Metals Inc. entitled: "An Introduction to Memrytec Shape Memory Alloys as Engineering Materials" dated in 1986. As will be explained in more detail subsequently, at ambient temperatures the coiled actuator 67 is fabricated to remain in a retracted position and to be extended to an elevated position in response to higher exterior temperatures. The ends of the actuator 67 are coupled between the support guide 44 and the annular shoulder 68 on the tubular support 40 for selectively shifting the support member upwardly from its normal retracted position shown in FIG. 2 to its elevated position depicted in FIG. 3 as the actuator spring is subjected to increasing well bore temperatures. It should also be noted that by virtue of forming the coiled actuator 67 from these shape memory metals, the biasing force that is supplied by the coiled actuator will increase in response to these increasing well bore temperatures. With some of these metals, it has been found that the biasing force can be increased in the order of something like ten times greater than the biasing force provided by the coiled actuator 67 at normal ambient temperatures.

The detonating system 10 of the present invention further includes an encapsulated booster explosive charge 70 which is cooperatively mounted within the lower end of the perforating carrier 19 and positioned to be located immediately above the upper end of the explosion-resistant container 31. The booster charge 70 may be any type of explosive booster (such as, for example, the boosters currently offered for sale by DuPont as its C-63 or P-52 boosters) suitable to act as a receptor charge for the donor charge represented by the particular detonator 32 and which has sufficient explosive power to produce a high-order detonation of the detonating cord 20 in response to the firing of the electric detonator. Although alternative types of booster charges can be effectively used as a receptor charge without departing from the intended scope of the present invention, the booster charge 70 will typically carry a small quantity of RDX or other secondary explosive (not illustrated) which is encapsulated in an elongated tubular metal shell 71. To operatively couple the booster 70 to the detonating cord 20, the upper end of the booster shell 71 is arranged with an upstanding socket into which the lower end of the detonating cord is fitted and secured by one or more circumferential crimps 72.

It will, of course, be appreciated that the detonator 32 is capable of reliably setting off the booster charge 70 only so long as the explosive devices are within detonating proximity of each other and there is no substantially obstruction blocking the detonation path of the electric detonator. Thus, in keeping with the objects of the invention, the new and improved detonating system 10 is cooperatively arranged to prevent the inadvertent actuation of the booster charge 70 in the unlikely event that the detonator 32 is unwittingly set off in any manner. As one major aspect of the present invention, therefore, the detonating system 10 is cooperatively arranged so that whenever the detonator 32 is in its initial or disarmed position illustrated in FIG. 2, the resulting detonating forces will be wholly contained within the explosion-resistant container 31 should the electric detonator be inadvertently set off.

As a further aspect of the invention, it has also been found that a secondary explosive or receptor charge such as the booster shown at 70 can be reliably disabled by installing a detonating barrier 75 formed of a low-temperature fusible metal alloy in the detonation path of the donor charge (such as the detonator 32) for reliably attenuating the explosive forces produced by the detonation of the donor charge. With this unique barrier 75, the perforating gun 11 will be reliably and predictably disarmed so long as the fusible alloy forming the barrier is not subjected to well bore temperatures greater than the selected melting point of the alloy for a sufficient time period that the fusible barrier will be softened or melted.

From FIG. 2 it will be noted that the solidified barrier 75 will prevent the biasing force of the temperature-responsive actuator 67 from shifting the detonator 32 upwardly through the opening 56 in the upper end plug 47. It will also be noted from FIG. 2 that a chamber 76 which is in fluid communication with the central opening 57 is formed at some convenient location immediately above the central opening. In the preferred manner of arranging the new and improved detonating system 10, this chamber 76 may take the place of an annular member 77 that is coaxially mounted on top of the upper end plug 47. The precise location of the chamber 76 within the carrier 19 is unimportant, however, so long as the chamber is in fluid communication with the central opening 57. The purpose of this chamber 76 will be subsequently explained.

Accordingly, with the detonating system 10 illustrated in FIG. 2, the unique disabling functions of the barrier 75 are preferably carried out by arranging the barrier in the form of a cast plug of a selected low-temperature fusible metal alloy that preferably cast in place for completely filling the chamber 55 and obstructing the axial opening 57 in the upper end plug 47. Thus, with the barrier plug 75 blocking the opening 57, should the electric detonator 32 be inadvertently set off, it will be assured that the detonation forces developed by the donor charge represented by the detonator will be totally confined within the explosion-resistant container 31 and that none of the detonation forces that even reach the booster charge 70 much less set off the receptor charge represented by that explosive. It should be noted that by virtue of the pressure communication paths defined around the detonator leads 35 as they pass through the holes 50 and 51 in the lower end plug 47, the explosive gases produced by the explosion of the detonator 32 will be quickly vented out of the explosion-resistant container 31.

It will be appreciated, therefore, that by virtue of the downwardly-facing inclined walls 56 and the shoulder 66, even a strong explosion within the container 31 could not dislodge the barrier plug 75. It must be emphasized, moreover, that because of the explosion-resistant chamber 31, it is no longer necessary to employ special-purpose complicated and expensive detonators such as those presently being proposed to counter the risk of inadvertent detonations. Thus, in the practice of the present invention, it must be recognized that standard inexpensive, off-the-shelf commercial detonators such as the detonator 32 or the booster charge 70 can be safely employed in the detonating system 10 without risking the hazards that these detonators might be set off either by spurious electric signals or inadvertently applying power to the conductors in the suspension cable 12.

In the preferred manner of practicing the invention for safeguarding detonators such as the commercial detonators shown at 32 and 70, a cast barrier plug, as at 75, is considered to be the most-effective and inexpensive configuration. Nevertheless, inasmuch as various alloys of fusible metals can be inexpensively and easily formed in various shapes, the scope of the invention is considered to include the installation of a previously-formed fusible barrier of an appropriate shape at a convenient location between the donor and receptor explosives 32 and 70 in a well tool such as the perforator 11. Routine testing procedures will be needed, of course, to establish the critical parameters of the particular fusible detonation barriers that could be employed for reliably confining specific types of detonators.

The most-important function of the barrier plug 75 is, of course, to reliably disarm the perforator 11 so that the receptor explosive 70 will not be set off should the donor explosive 32 be inadvertently or prematurely detonated in any manner. Thus, it is essential that the barrier plug 75 be formed of a selected fusible alloy which will reliably remain in a solid state until the perforator 11 has been safely positioned in a well bore as at 14. Nevertheless, to successfully practice the invention, it is equally important that the barrier plug 75 will reliably respond to a predictable event and become incapable of functioning to safe-arm or disarm the perforator 11. Accordingly, the fusible metal alloy which is preferably employed for a particular barrier plug 75 will be a fusible metal alloy which has a melting point somewhat less than the temperature of the well bore fluids at the particular depth interval where the wireline perforator 11 is to be operated.

There are a variety of eutectic and non-eutectic fusible metal alloys that can be utilized in the practice of the present invention which are the various binary, ternary, quaternary and quinary mixtures of bismuth, lead, tin, cadmium and indium or other metals. When these fusible metals are eutectic alloys, the mixture has the unusual property of having a melting point lower than the lowest melting point for any of its constituents. This intrinsic melting point will be constant and, therefore, will be a precisely known temperature. Another unusual feature of any eutectic alloy is that its melting point is also its freezing point so that there is no freezing range between the liquid state and the solid state of the alloy. In other words, a solid body of any eutectic alloy is immediately converted to a liquid once that body reaches its intrinsic melting point. The fluidity of these liquid eutectic alloys is similar to the fluidity of liquid mercury at room temperature.

There are a variety of eutectic fusible alloys of bismuth with melting points that range all the way from 117° F. to 477° F. (4.8° C. to 247° C.). Those skilled in the art will appreciate, however, that ordinarily the well bore temperatures at the usual depths of most well service operations will be no more than about 300° F. (138° C.). As a practical matter, therefore, there is a group of seven eutectic alloys with melting points between 117° F. and 255° F. (46.8° C. to 124° C.) that are considered to be the most useful fusible metals for practicing the methods and apparatus of the present invention. Although standard handbooks of metallurgy will give the precise compositions for these seven bismuth alloys that will ideally serve for providing detonation barriers of the present invention, the eutectic alloy which is best suited for operation in most wells has a melting point of only 117° F. and is composed of 44.7% bismuth, 22.6% lead, 8.3% tin, 5.3% cadmium and 19.1% indium. The eutectic alloy which has the highest melting point of 255° F. is composed of 55.5% bismuth and 44.5% lead. The other five bismuth eutectic alloys in the group are each composed of varying amounts of the above-named alloys respectively having melting points falling between these two temperature limits. In any case, in the practice of the invention, at least one of these seven alloys will provide a reliable and predictable detonation barrier as at 75.

Those skilled inn the art will, of course, appreciate that there are also non-eutectic fusible alloys which may be employed in the practice of the invention. Instead of having precise melting points and an immediate change from the solid state to the liquid state, the non-eutectic alloys have a moderate range of melting points and their intermediate state is similar to slush as the alloy is heated from the lower limit of its melting range to the upper limit of that range. For instance, one common non-eutectic fusible metal alloy is composed of 50.5% bismuth, 27.8% lead, 12.4% tin and 9.3% cadmium which has an intrinsic melting range of 158° C. to 163° F. (i.e., 70.5° C. to 7.25° C.). With other non-eutectic alloys in the same family, decreases in the percentage of bismuth to 35.1% and corresponding increases of the percentage of lead to 36.4% will result in a group of fusible metals with a range of melting points between the lower limit of 158° F. and progressively-higher upper limits up to 214° F. (111° C.). A second low-temperature non-eutectic alloy which can be utilized is composed of 42.9% bismuth, 21.7% lead, 7.97% tin, 18.33 indium and 4.00% mercury. This latter non-eutectic alloy has a range of melting points between 100° F. to 110° F. (37.8° C. to 43.3° C.). It is, of course, readily apparent that the melting range of this second non-eutectic alloy is so low that this alloy could be used in any well. Moreover, the first-mentioned non-eutectic alloy having the lower range of 158° F. to 163° F. can be utilized in most well bore operations to provide a reliable and predictable detonation barrier such as at the fusible plug 75.

Hereagain, it must be realized that the paramount purpose of the invention is to provide detonation barriers having reliable and predictable disabling features as well as enabling features. Thus, there could well be various situations where the well bore temperatures are so hot that those non-eutectic fusible alloys with wider ranges of melting temperatures can be utilized as well in order to provide sufficiently reliable and predictable barrier members. The important thing to remember is that the melting point of a given fusible metal is an intrinsic property whether that metal is a eutectic alloy having a single melting point of a known value or is a non-eutectic alloy which has a defined range of melting temperatures. In either case, it is the intrinsic melting temperature of these fusible alloys which provides the reliability and predictability features of the new and improved barrier means of the invention.

Accordingly, turning now to FIG. 3, the detonating system 10 is depicted to show how the temperature-responsive actuator 67 and the detonation barrier 75 are utilized for reliably arming the perforator 11 once it has been lowered into a well bore. The detonating system 10 is depicted as it will appear when the well bore temperatures exterior of the perforator 11 have been at an elevated level to melt the fusible alloy forming the barrier 75 and thereafter enable the coiled actuator 67 to then shift the tubular support 40 upwardly to its extended position in response to somewhat-higher well bore temperatures. As the temperature-induced biasing force of the actuator 67 shifted the support member 40 to its illustrated elevated position, the liquefied metal produced upon melting of the barrier 75 was displaced into the chamber 76 by the upwardly-moving detonator 32. Hereagain, it must be appreciated that by virtue of this intrinsic melting point of a particular fusible metal alloy being used, the barrier 75 will reliably and predictable safeguard the booster 70 against premature actuation and thereafter reliably and predictably arm the perforating gun 11 once the barrier has been melted and the temperature-responsive actuator 67 has moved the detonator 32 into detonating proximity of the booster 70.

It will be recognized that once the fusible metal alloy 75 is liquefied, the detonator will no longer be obstructed by the plug and the detonator is then free to move through the central opening 57 in the upper end plug 47 so as to be certain that the detonator 32 is capable of initiating the booster 70. It should be noted that the essential point is that when the fusible alloy is solidified, it is the presence of the solid barrier 75 itself that will prevent the receptor charge in the booster 70 from being set off should the detonator 32 be inadvertently actuated. In other words, even if the detonator 32 and the booster 70 are closely spaced, the solid barrier 75 will reliably attenuate the explosive forces produced by the inadvertent detonation of the detonator. Once, however, the barrier member 75 has melted and the detonator 32 has moved upwardly through the liquefied metal, the perforator 11 is then reliably armed and the detonator 32 is readied for selective actuation from the surface by whatever means are to be used for setting off the donor charge. Thus, when the detonator or donor charge 32 is detonated, the booster or receptor charge 70 will be set off to selectively actuate the perforator 11. As previously discussed, the particular manner in which the detonating system 10 is to be actuated from the surface is unrelated to the practice of the present invention.

Ordinarily it is of no consequence that the perforator 11 is armed at some safe depth in a well bore since the perforator will typically be fired once it has been properly positioned in the well bore. Nevertheless, those skilled in the art will recognize that, at times, a perforating gun must be returned to the surface without firing the shaped charges carried by the gun. Moreover, it is not too uncommon for a well perforator to be returned to the surface without realizing that some unnoticed or unknown malfunction had prevented the explosives from being detonated as planned. In either situation, it is always considered risky to return an armed perforating gun to the surface with an unexpended detonator; and there is a distinct risk that the detonator may be inadvertently detonated after the tool has been removed from the well bore. Accordingly, as the perforator 11 is being returned to the surface, the progressive reductions in ambient well bore temperatures will be effective for returning the actuator 67 to its "remembered" initial position. At that lower temperature level, the actuator 67 will cooperatively function for restoring the unexpended donor charge 32 to its initial retracted position inside of the explosion-resistant container 31. Hereagain, by virtue of the significant biasing force provided by the actuator 67 at elevated well bore temperatures, it will be appreciated that there will be a substantial force effective for returning the unfired detonator 32 to its initial position.

Once the donor charge 32 has been returned to its initial lower position most, if not all, of the liquefied metal from the barrier 75 will be returned to the enlarged chamber 55 by way of the opening 57. The liquefied metal returned to the chamber 55 will then resolidify to reform the solid barrier plug 75 as the perforator 11 subsequently encounters cooler well bore fluids in the well bore. It will, of course, be realized that the presence of the fusible metal in either the chamber 55 or the upper space 76 will be effective for permanently disabling the donor charge 32 once this fusible metal has resolidified and recreated another barrier member 75. In any case, resolidification of the barrier member 75 will ultimately be carried out by the time that the perforator 11 is ready for removal from the well bore.

In selecting the respective operating temperatures for the coiled actuator 67 and the barrier member 75, the only criteria is to be certain that the melting point of the fusible alloy in the barrier member 75 is lower than the "memory" temperature at which the actuator 67 will revert to its original configuration. Since the melting point of the fusible alloy is precisely known if the metal is a eutectic alloy, there will be no problem in establishing this lower temperature. Similarly, since the shape memory alloys which can be typically utilized for the actuator 67 also have fairly-well defined temperature limits, there will be a variety of these alloys that can be selected for assembling detonator systems 10 in accordance with the principles of the invention.

It will, of course, be recognized that the biasing force provided by the actuator 67 must be coordinated with respect to the well bore pressures so that there will be no unbalanced pressure forces that would keep the actuator from functioning for elevating the donor charge 32 into detonating proximity of the receptor charge 70 whenever the detonating system 10 is to be enabled. In the same fashion, the compression spring 65 must be capable of assisting the actuator 67 to return the donor charge 32 to its initial retracted position for separating the donor charge from the receptor charge 70 before the liquefied fusible metal resolidifies in the chamber 55 as the perforator 11 is being returned to the surface.

It must be recognized, therefore, that because of the unique intrinsic nature of the metals respectively used to form the actuator 67 and the barrier 75, it can be accurately predicted that the perforator 11 will be safely disarmed until it has been exposed to a known well bore temperature for a reasonable period of time. Those skilled in the art will appreciate the importance of the reliability and predictability of the respective disarming and arming functions of the actuator 67 and the barrier member 75. It will also be appreciated that it is of major importance to know that the perforator 11 will be armed and ready for its intended operation only while it remains at a selected well bore location. It will be realized, moreover, that the actuator 67 and the barrier 75 will reliably function to disarm the perforator 11 should it become necessary to recover it without carrying out its intended operation in a desired well bore interval. Hereagain, the value of these features of the present invention can not be underestimated.

In the preferred practice of the invention, multiple sets of detonating systems 10 are prepared in advance with barrier plugs, as at 75, from various compositions of fusible metal alloys which are respectively selected to have different melting points spread over a desired range of anticipated well bore temperatures. In this way, a variety of the detonating systems 10 can be arranged by using actuators 67 and barrier plugs 75 of different selected temperature ratings to enable a well tool such as the perforator 11 to be quickly assembled as needed to operate at various well bore temperatures. The selection of a specific detonating system 10 with distinctive actuators 67 and barriers 75 for a particular operation will be made in accordance with the anticipated well bore temperature conditions that the well tool might be expected to encounter during the forthcoming operation.

Even if the well temperatures are not known in advance, the service crew can readily defer the installation of a detonating system 10 with the appropriate temperature ratings until the actual temperatures are determined. It will be appreciated that since the electric detonators, as at 32, are always confined in the explosion-resistant container 31, the perforating gun 11 is completely safeguarded whether or not a detonating system 10 is installed in the perforator. In any event, once a detonating system 10 with appropriate temperature rating is installed, the perforator 11 will be reliably disabled until the perforator is lowered into the well bore. Should there be spurious electrical signal that prematurely detonates the detonator 32, the barrier plug 75 will reliably prevent the booster charge 70 from being set off whether the perforator 11 is at the surface or is in the well bore.

Turning now to FIG. 4, an alternative detonating system 100 arranged in keeping with the principles of the invention is depicted as including an explosion-proof hollow housing 101 which is mounted in an upright position within the lower portion of the carrier 19. For the large part, the explosion-proof housing 101 is similar to the previously-described explosion-proof housing 31 and is fabricated as a high-strength steel tube with a sufficient wall thickness for suppressing the anticipated explosive forces of an electric-initiated detonator 102 enclosed therein. Since the lower portion of the housing 101 is preferably arranged in the same manner as the housing 31, the lowermost portion of the explosion-proof housing for the alternative detonating system 100 is not illustrated in FIGS. 4 and 5. As in the case with the other housing 31, the lower end of the housing 101 is closed by a threaded end plug with small holes in its base through which the electrical leads of the detonator are extended. Hereagain, like the previously-described housing 31, the small holes in the lower end plug (not illustrated) are appropriately sized to provide a pressure-communication path from the interior of the explosion-proof housing 101 to facilitate the escape of the explosive gases that would be produced should the detonator 102 be inadvertently set off while the detonation system 100 is at the surface. Those skilled in the art will, of course, appreciate that by virtue of the strength of the housing 101, the explosive forces that would be caused by the inadvertent detonation of the detonator 102 will be effectively suppressed within the explosion-proof housing and the holes in the lower end plug (not illustrated) will quickly vent off any pressure that might otherwise be built-up in the housing without representing a dangerous situation for personnel and equipment in the vicinity of the new and improved detonating system 100.

In contrast to the previously-described detonation system 10, the detonator 102 is secured in an upright position within the explosion-proof housing and coaxially aligned in the housing by means such as an annular spacer 103 which is disposed in the central longitudinal bore 104 of the housing 101. As illustrated in FIG. 4, the central longitudinal bore 104 is counterbored for defining an upwardly-opening enlarged chamber for receiving packing means 106 which (in the same manner as the packing means 60 employed in the detonating system 10) are coaxially arranged around the upper portion of the detonator 102. The packing means 106 include an upwardly-facing Teflon chevron-shaped ring 107 complementally disposed within a downwardly-facing metal support ring 108 and supported on the upper face of a flat annular washer 109 loosely disposed around the upper end of the stationary detonator 102.

The upper end of the longitudinal passage 104 in the upper end plug 103 is also counterbored and threaded to provide an enlarged chamber 110 in which an externally-threaded end plug 111 is threadedly mounted. The longitudinal bore through the end plug 111 is internally shaped to define an enlarged chamber 112 in which a fusible metal alloy barrier 113 is cast in place. As previously described with respect to the detonating system 10, the meltable barrier 113 in the detonation system 100 is also formed of a selected one of the aforementioned non-eutectic and non-eutectic fusible alloys and similarly retained by downwardly-inclined walls 114 at the upper end of the enlarged chamber 112 which terminate with a central opening 115. In keeping with the objects of the present invention, it must, of course, be realized that the particular one of the several fusible metal alloys which should be utilized for forming the fusible barrier 113 will be dependent upon the well bore conditions in which a particular well service operation that is being considered will be carried out. Hereagain, the paramount purpose of the invention is to provide detonation barriers, as at 113, having reliable and predictable disabling features as well as enabling features.

In further contrast to the previously-described detonation system 10, the alternative detonation system 100 of the present invention includes an encapsulated booster explosive charge 120 which is movably mounted within an elongated tubular support 121 coaxially disposed within the perforator carrier 19 immediately above the upper end plug 107. As depicted, the movable tubular support 121 is coaxially mounted within a tubular housing 122 that is itself secured within the lower end of the perforator carrier 19. In the preferred manner of arranging the detonating system 100, the lower end portion of the fixed housing 122 is reduced in diameter; and, once the packing means 106 have been positioned in the cavity 105, the housing is threadedly secured within the internally-threaded counterbore 110 at the upper end of the explosion-proof housing 101.

It will, of course, be appreciated that the booster charge 120 may be any type of explosive booster such as those boosters previously described with respect to the detonating system 10. To effectively couple the booster 120 to the shaped explosive charges (not illustrated in FIG. 4) in the carrier 19, a short length of detonating cord (not shown) is cooperatively coupled to the upper end of the booster charge 120 and disposed adjacent to the lower portion of the detonating cord 20 in the carrier. To keep the short detonating cord within detonating proximity of the main detonating cord 20, the adjacent end portions of these two detonating cords are respectively disposed in a side-by-side relationship within an annular spacer 123 having a longitudinal passage 125 with an oblong cross-section appropriately sized to accommodate limited upward and downward movements of the short cord in relation to the main detonating cord.

As shown in FIG. 4, the support tube 121 is cooperatively arranged for normally positioning the lower end of the movable booster 120 immediately above the upper surface of the fusible barrier 113. The lower portion of the housing 122 is arranged for receiving a packing assembly or an annular sealing member 126 cooperatively arranged around the lower portion of the booster 120. If a multi-component packing assembly is employed, it would be preferably arranged in the same manner as the packing means 60 and 106.

In keeping with the objects of the invention, an elongated compression spring 127 is coaxially mounted around the lower portion of the booster 120 and moderately compressed between a flat washer 128 on the upper face of the sealing member 126 and the lower end of the support tube 121 for normally urging the movable booster support upwardly in the housing 122. The new and improved detonating system 100 of the present invention further includes biasing means such as a unique temperature-responsive actuator 129 cooperatively arranged within the tubular housing 122 for urging the booster support 121 downwardly in relation to the housing with a biasing force that substantially increases in response to increasing exterior temperatures for countering the moderate constant upwardly-acting force provided by the spring 127. In the preferred embodiment of the detonating system 100, the unique actuator 129 is coaxially disposed within the tubular housing 122 and cooperatively arranged around the tubular support 121 between a shoulder 130 within the upper end of the tubular housing and a shoulder 131 around the mid-portion of the movable support. The temperature-responsive actuator 129 is movably arranged in the tubular housing 122 and cooperatively arranged for moving the booster charge 120 downwardly from its depicted elevated position in response to increasing temperatures outside of the detonating system 100. In its preferred embodiment, the actuator 129 is essentially identical to the actuator 67 in the detonating system 10 and is also formed of a so-called "shape memory metal" having a "two-way memory" such as the alloys that are manufactured by Memory Metals Inc. of Stamford, Conn., and marketed under the trademark Memrytec. Hereagin, whenever the actuator 129 is at ambient temperatures, the coaxially-coiled actuator will remain in a retracted position and will be forcibly extended to an extended position in response to increasing well bore temperatures to impose increasing biasing forces against the booster charge 120.

Figure 5:
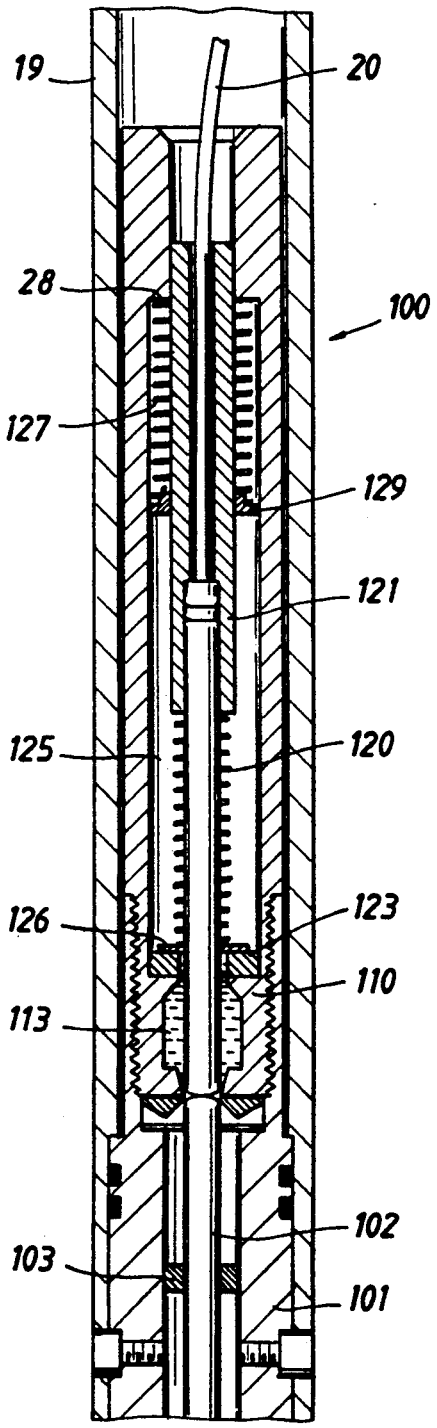

Turning now to FIG. 5, the detonating system 100 is shown after the temperature-responsive actuator 129 and the detonation barrier 113 have cooperatively armed the perforator 11 once it has been lowered into a well bore to a depth level where elevated well bore temperatures have melted the fusible barrier as well as caused the actuator to shift the tubular support 121 downwardly to its extended position. As the temperature-induced force of the actuator 129 shifted the support member 121 downwardly, the liquefied metal produced upon the melting of the barrier 113 was displaced upwardly into the space defined immediately around the lower portion of the downwardly-moving booster 120 and between the spatially-disposed packing means 106 and 126. Hereagain, by virtue of the particularly fusible metal alloy being used, the meltable barrier 113 will predictably safeguard the booster 120 from being prematurely set off by the inadvertent detonation of the detonator 102 and thereafter arm the perforating gun 11 once the temperature-responsive actuator 129 has moved the booster charge 120 downwardly through the melted barrier into detonating proximity of the detonator. As previously described, as the booster 120 is moved downwardly in the carrier 19, there will be a corresponding downward movement of the short detonating cord 123 in relation to the main detonating cord 20.

Once the fusible barrier 113 is liquefied, the detonator 102 will no longer be blocked by the plug and the booster 120 is free to move through the central opening 115 in the upper end plug 111 to be certain that the booster will be in detonating proximity of the detonator 102. Hereagain, it should be noted that when the fusible barrier 113 is solidified, it is the solid barrier itself that protects the booster 120 should the detonator 102 be set off somehow. In other words, regardless of the spacing of the two charges 102 and 120, the solidified barrier 113 will reliably attenuate the explosive forces that would be produced by the inadvertent detonation of the detonator. Once, however, the barrier 113 has melted and the booster 120 has moved downwardly through the liquefied metal, the perforator 11 is then reliably armed and the detonator 102 is readied for selective actuation from the surface.

When the armed perforating gun 11 is being returned to the surface with the detonator 102 still unexpended, the progressive reductions in ambient well bore temperatures will be effective for returning the coiled actuator 129 to its "remembered" initial position. At that lower temperature level, the actuator 129 will impose a substantial biasing force for restoring the unexpended booster charge 120 to its initial retracted position inside of the tubular housing 122 by virtue of the elevated temperatures in the well bore. Once the booster charge 120 has been returned to its initial retracted position most, if not all, of the liquefied metal from the barrier 113 will be returned to the chamber 112 and resolidified to reform the solid barrier as the perforator 11 subsequently encounters cooler well bore fluids in the well bore. Hereagain, it will be recalled that the only criteria is that the melting point of the fusible alloy in the barrier 113 is lower than the "memory" temperature at which the actuator 129 reverts to its original configuration to be assured that the perforator 11 will be safely disarmed until it has been exposed to a known well bore temperature for a reasonable period of time.

In the preferred practice of the invention, the detonating system 100 is provided with multiple sets of the upper end plugs 111 with fusible barriers 113 selected to operate over a desired range of the anticipated well bore temperatures. In a similar fashion, a variety of the actuators 127 of different selected temperature ratings will further enable a well tool such as the perforator 11 to be quickly assembled as needed to operate at various well bore temperatures. The selection of a specific detonating system 100 with distinctive barriers 113 and actuators 127 will, of course, be made in keeping with the anticipated well bore temperature conditions that the well tool might be expected to encounter during a forthcoming operation. It must be realized that since the electric detonator 102 is always confined in the explosion-resistant container 101, the perforating gun 11 will be completely safeguarded whether or not the detonating system 100 is in the perforator. Should there be spurious electrical signal that prematurely detonates the detonator 102, the barrier plug 113 will reliably prevent the booster charge 120 from being set off whether the perforator 11 is at the surface or is in the well bore. In any event, once a detonating system 100 of appropriate temperature rating is installed in the perforator 11, it will be reliably disabled until it has been lowered to a safe depth in the well bore.

Figure 6:
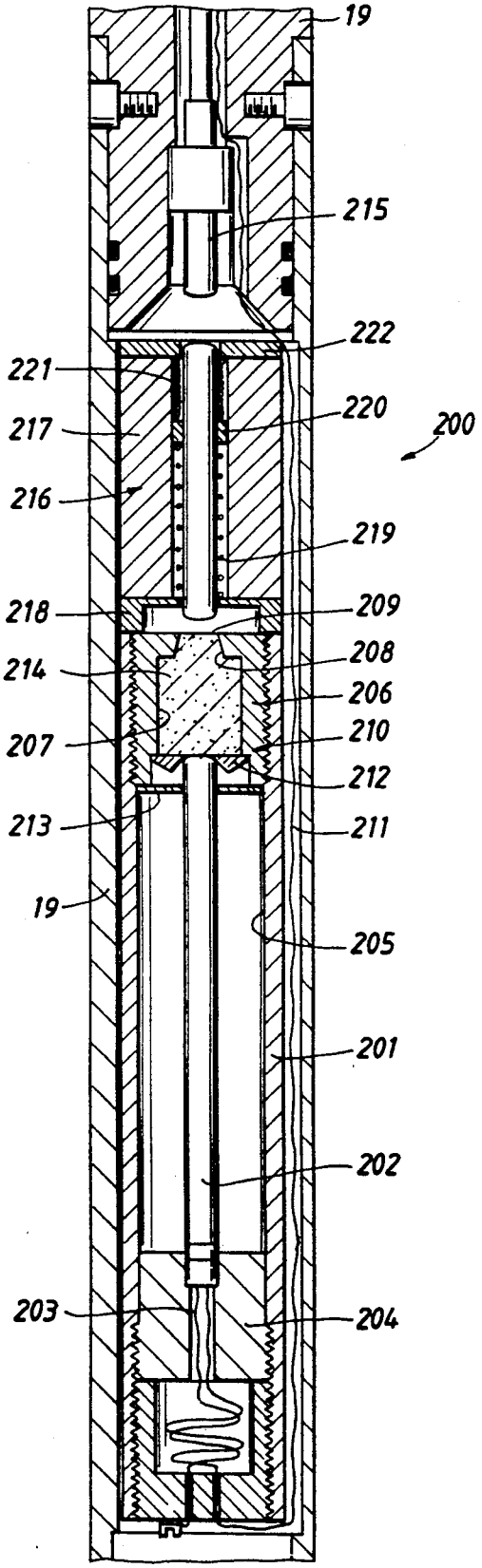
FIGS. 6 and 7 are elevational views depicting yet another alternative detonating system as this third system will appear for selectively disarming and then arming the perforator shown in FIG. 1 for selective initiation from the surface.

Turning now to FIG. 6, another alternative detonating system 200 arranged in keeping with the principles of the invention is depicted as including an explosion-proof hollow housing 201 mounted in an upright position within the lower portion of the carrier 19. For the large part, the explosion-proof housing 201 is essentially similar to the two previously-described explosion-proof housings 31 and 101 and is fabricated as a high-strength steel tube with a sufficient wall thickness for suppressing the anticipated explosive forces of an electric-initiated detonator 202 enclosed therein. Since the housing 201 is preferably arranged in the same manner as the housings 31 and 101, the lowermost portion of the explosion-proof housing 201 is not illustrated in FIGS. 4 and 5. The lower end of the housing 201 is closed by a threaded end plug (not illustrated) with small holes through which the electrical leads 203 of the detonator 202 are extended, with these holes being appropriately sized provide a pressure-communication path for the escape of explosive gases should the detonator be inadvertently set off while the new and improved detonating system 200 is at the surface. Hereagain, by virtue of the strength of the housing 201, the explosive forces caused by an inadvertent detonation of the detonator 102 will be suppressed within the explosion-proof housing and the holes in the lower end plug (not illustrated) will quickly vent off any pressure that might otherwise be built-up in the housing without representing a dangerous situation for personnel and equipment in the vicinity of the detonating system 200.

In contrast to the previously-described detonation system 10, the detonator 202 is secured in an upright position within the explosion-proof housing by means such as an annular spacer 204 which is disposed in the longitudinal bore 205 of the housing 201 and rested on top of the lower end plug (not illustrated). As illustrated in FIG. 6, the axial bore in the spacer 204 is sized to accommodate the electrical leads 203 for the detonator and is also counterbored at its upper end to define a socket in which the lower end of the detonator 202 is rested.

The upper end of the longitudinal housing bore 205 is also counterbored and threaded to receive an externally-threaded end plug 206 which, in keeping with the principles of the present invention, is fabricated to provide a longitudinal passage which includes an enlarged-diameter chamber 207 in the mid-portion of the plug. The upper end of the enlarged chamber 207 in the end plug 206 is terminated by upwardly-converging interior walls 208 ending with a circular opening 209 in the upper face of the end plug. The lower end of the central passage through the upper end plug 206 is counterbored to provide a downwardly-facing chamber in which packing means 210 are arranged for providing substantial sealing engagement around the upper end of the detonator 202. In the new and improved detonating system 200, the packing means 210 preferably include an upwardly-facing chevron packing ring 211 of Teflon complementally receiving a downwardly-facing frustoconical metal support ring 212. The lower face of the Teflon packing element is supported on the upper face of a flat annular washer 213 loosely disposed around the detonator 202 and rested on a shoulder in the threaded bore receiving the end plug 206 for positioning the washer just below the sealing rings 211 and 212.

As previously described with respect to the detonating systems 10 and 100, a meltable barrier 214 is also formed of a selected one of the aforementioned eutectic and non-eutectic fusible alloys and cast in place within the enlarged chamber 207 and terminated at the central opening 209. In keeping with the objects of the invention, the particular alloy utilized for the fusible barrier 214 will depend upon the well bore conditions in which a particular well service operation will be carried out. Hereagain, the paramount purpose of the invention is for the detonation barrier 214 to have reliable and predictable disabling features as well as enabling features.

The detonating system 200 of the present invention further includes an encapsulated booster charge 215 which, in the same manner as the booster 70 in the detonating system 10, is also cooperatively mounted in a fixed position within the perforating carrier 19 to be located a short distance above the upper end of the explosion-resistant housing 201. The booster charge 215 may by any type of explosive booster (such as, for example, a DuPont C-63 or P-52 booster) with sufficient explosive power to produce a high-order detonation of the detonating cord 20 in response to the firing of the electric detonator 202. To operatively couple the detonating cord 20 to the booster 215, the lower end of the detonating cord is secured in the typical fashion within a socket in the upper end of the stationary booster.

In further contrast to the detonation systems 10 and 100, the alternative detonation system 200 of the present invention includes an encapsulated intermediate explosive charge 216 which is movably mounted within a tubular support 217 that is coaxially disposed within the carrier 19 and supported on an annular spacer 218 that is itself rested on the upper end of the explosion-proof housing 201 and the upper end plug 206. As depicted in FIG. 6, the tubular support 217 and annular spacer 218 are cooperatively arranged for normally positioning the lower end of the movable intermediate charge 216 immediately above the upper surface of the fusible barrier 214. It will, of course, be appreciated by those with skill in the art that this intermediate explosive charge 216 must itself represent a receptor explosive that will be detonated by the explosive force of the stationary detonator 202 and a donor explosive that will, in turn, set off the fixed booster charge 215. Although this dual role of being a receptor and a donor explosive can be accomplished in various ways, in the preferred embodiment of the detonating system 200 it is preferred that the intermediate charge 216 be arranged as an upper booster charge that has its lower end tandemly connected to the upper end of a lower booster charge by a short length of detonating cord (none of which are illustrated). In this manner, the detonation of the detonator 202 will set off the lower booster charge in the movable intermediate charge that is facing downwardly. The lower booster will, in turn, set off the short interconnecting length of detonating cord to detonate the upwardly-facing booster charge in the movable intermediate charge 216. Those skilled in the art will, of course, appreciate that other arrangement of explosives can be made to serve as the intermediate explosive 216 without departing from the scope of the present invention.

In keeping with the objects of the invention, an elongated compression spring 219 is coaxially mounted around the lower portion of the movable charge 216 and moderately compressed between a collar 220 secured around the mid-portion of the movable charge and the upper face of the annular spacer 218 for normally urging the movable charge upwardly in the carrier 19. The new and improved detonating system 200 of the present invention further includes biasing means such as a unique temperature-responsive actuator 221 cooperatively arranged within the tubular support 217 for urging the intermediate charge 216 downwardly in relation to the carrier 19 with a biasing force that substantially increases in response to increasing exterior temperatures for countering the moderate constant upwardly-acting force provided by the spring 219. In the preferred embodiment of the detonating system 200, the unique actuator 221 is coaxially disposed within the tubular support 217 and arranged around the movable charge 216 between the upper end of the collar 220 and a flat annular washer or spring retainer 222 mounted on the upper end of the tubular support. The temperature-responsive actuator 221 is cooperatively arranged in the tubular support 217 for moving the intermediate charge 216 downwardly from its depicted elevated position in response to increasing temperature outside of the detonating system 200. In its preferred embodiment, the actuator 221 is essentially identical to the actuators 67 and 127 in the detonating systems 10 and 100 and is also formed of a so-called "shape memory metal" having a "two-way memory" such as the Memrytec alloys that are manufactured by Memory Metals Inc. of Stamford, Conn. Hereagain, whenever the actuator 221 is at lower temperatures, the coaxially-coiled actuator will be in its illustrated retracted position and will be forcibly extended to an extended position as the surrounding well bore temperatures increase and thereby impose increasing biasing forces downwardly against the movable charge 216.

Figure 7:
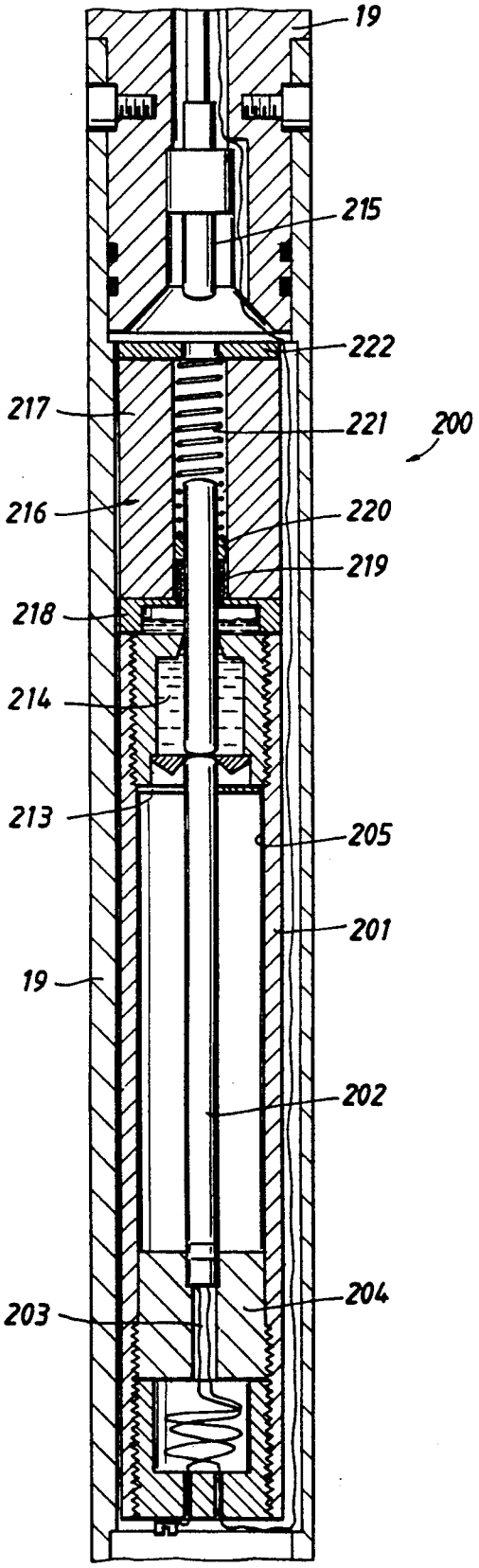

Turning now to FIG. 7, the detonating system 200 is shown after the temperature-responsive actuator 221 and the detonation barrier 214 have cooperatively armed the perforator 11 once it has been lowered into a well bore to a depth level where elevated well bore temperatures have melted the fusible barrier as well as caused the actuator to shift the movable charge 216 downwardly to its extended position. As the temperature-induced force of the actuator 221 shifted the movable intermediate charge downwardly, the liquefied metal produced upon the melting of the barrier 214 was displaced upwardly into the spaced or collection reservoir defined immediately around the lower portion of the downwardly-moving intermediate explosive 216 and the downwardly-directed rim of the annular spacer 218. Hereagain, depending upon which of the several available fusible metal alloys is being used, the meltable barrier 214 will predictably safeguard the booster 215 from being prematurely set off by the inadvertent detonation of the detonator 202 and thereafter arm the perforating gun 11 only after the temperature-responsive actuator 221 has shifted the nose of the movable charge 216 through the melted barrier into detonating proximity of the detonator.

Once the fusible barrier 214 is liquefied, the detonator 202 will no longer be blocked by the solid barrier and the increasing biasing force of the thermally-responsive actuator 221 will shift the movable charge 216 through the opening 209 in the upper end plug 206 and the now-liquefied alloy in the enlarged chamber 207 to bring and lower end of the intermediate charge into detonating proximity of the upper end of the detonator. Hereagain, it will be noted that when the fusible barrier 214 is solidified, it is the solid barrier itself that protects the booster 215 should the detonator 202 be set off somehow. In other words, regardless of the spacing of the charges 202 and 216, the solidified barrier 214 will reliably attenuate the explosive forces that would be produced by the inadvertent detonation of the detonator. Once, however, the barrier 214 has melted and the intermediate charge 216 has moved downwardly through the liquefied metal alloy in the chamber 207, the perforator 11 is then reliably armed and the detonator 202 is readied for selective actuation from the surface.

When the armed perforating gun 11 is being returned to the surface with the detonator 202 still unexpended, the progressive reductions in ambient well bore temperatures will be effective for returning the coiled actuator 221 to its "remembered" initial position. At that lower temperature level, the actuator 221 will impose a substantial biasing force for restoring the unexpended intermediate charge 216 to its initial retracted position inside of the tubular support 217 by virtue of the elevated temperatures in the well bore. Once the movable intermediate charge 216 has been returned to its initial retracted position most, if not all, of the liquefied metal from the barrier 214 will be returned to the chamber 207 and resolidified to reform the solid barrier as the upwardly-moving perforator 11 subsequently encounters cooler well bore fluids at higher depth locations. Hereagain, it will be recalled that the only criteria is that the melting point of the fusible alloy in the barrier 214 is lower than the "memory" temperature at which the actuator 221 reverts to its original configuration to be assured that the perforator 11 will be safely disarmed until it has been exposed to a known warmer well bore temperature for a reasonable period of time.

In the preferred practice of the invention, the detonating system 200 is also provided with multiple sets of the upper end plugs 206 with fusible barriers 214 selected to operate over a desired range of the anticipated well bore temperatures. In a similar fashion, a variety of the actuators 221 of different selected temperature ratings will further enable a well tool such as the perforator 11 to be quickly assembled as needed to operate at various well bore temperatures. The selection of a specific detonating system 200 with distinctive barriers 214 and actuators 221 will, of course, be made in keeping with the anticipated well bore temperature conditions that the well tool might be expected to encounter during a forthcoming operation. It must be realized that since the electric detonator 202 is always confined in the explosion-resistant housing 201, the perforating gun 11 will be completely safeguarded whether or not the detonating system 200 is in the perforator. Should there be spurious electrical signal that prematurely detonates the detonator 202, the barrier 214 will reliably prevent the intermediate charge 216 from being set off whether the perforator 11 is at the surface or is in the well bore. In any event, once a detonating system 200 of appropriate temperature rating is installed in the perforator 11, it will be reliable disable until it has been lowered to a safe depth in the well bore.

Accordingly, it will be seen that the present invention has provided new and improved methods and apparatus for selectively initiating various perforators from the surface. In particular, the present invention represents a new and improved explosive detonating system that prevents the explosive devices coupled thereto from being sent off by extraneous electromagnetic signals or by spurious electrical energy while they are at the surface. Moreover, the invention provides new and improved methods for safeguarding explosive devices from inadvertent detonation and for selectively initiating these explosive devices only after they have reached a safe position by rendering the explosives inoperable until those perforators have been exposed to elevated well bore temperatures for a finite time period. The present methods and apparatus of the invention will also render these perforators inoperable should they be returned thereafter to the surface without having been operated properly.

While only particular embodiments of the present invention and modes of practicing the invention have been described above and illustrated in the drawings, it is apparent that changes and modifications may be made without departing from the invention in its broader aspects; and, therefore, the aim in the claims which are appended hereto is to cover those changes and modifications which fall within the true spirit and scope of the invention.

What is claimed is:

1. A well tool to be suspended in a well bore and comprising:

a body;

an explosive device on said body;

first means on said body for detonating said explosive device including a receptor explosive, and an electrically-initiated donor explosive selectively operable for producing an explosive force of sufficient magnitude to set off said receptor explosive;

explosion-proof housing means arranged on said body enclosing said donor explosive for confining its said explosive force and including an access opening situated between said explosives, and an explosion-proof barrier of a fusible metal alloy blocking said access opening for shielding said receptor explosive from said explosive force so long as the temperature of said barrier stays below the melting point of said alloy; and second means operable only after said barrier has melted for advancing one of said explosives into said access opening within detonating proximity of the other of said explosives for arming said well tool for selective initiation by an electrical signal to detonate said explosive device in a well bore.

2. The well tool of claim 1 wherein said fusible metal alloy is selected from the group consisting of binary, ternary, quaternary and quinary eutectic and non-eutectic mixtures of bismuth, lead, tin, cadmium and indium.

3. The well tool of claim 1 including a collection chamber next to said access opening; and wherein said second means include temperature-responsive biasing means operable in response to increasing well bore temperatures above said melting point for advancing said one explosive into said access opening to displace the melted alloy into said chamber and bring said one explosive within detonating proximity of said other explosive and operable in response to decreasing well bore temperatures above said melting point for withdrawing said one explosive from said access opening and out of detonating proximity of said other explosive as the still-melted alloy returns from said collection chamber to reblock said access opening and isolate said donor explosive in said explosive-resistant housing means upon resolidification of said alloy in response to well bore temperature below said melting point to reform said barrier while said well tool is still suspended in a well bore.

4. The well tool of claim 1 wherein said first means further include explosive means cooperatively arranged between said receptor explosive and said explosive device for serially transferring the explosive force of said receptor explosive to said explosive device to detonate said explosive device upon selective initiation of said donor explosive after said fusible metal alloy has melted.

5. The well tool of claim 1 wherein said second means include a temperature-responsive actuator operable in response to well bore temperatures greater than said melting point for advancing said one explosive at least partway through said access opening.

6. The well tool of claim 5 wherein said fusible metal alloy is selected from the group consisting of binary, ternary, quaternary and quinary eutectic and non-eutectic mixtures of bismuth, lead, tin, cadmium and indium and has a melting point lower than the anticipated well bore temperatures in a selected well bore.

7. The well tool of claim 6 wherein said one explosive is said donor explosive, said other explosive is said receptor explosive; and said second means further include a temperature-responsive actuator fabricated from a shape memory metal and operable only in response to elevated well bore temperatures greater than said melting point for advancing said donor explosive into said access opening and at least partway outside of said housing means to position said donor explosive within detonating proximity of said receptor explosive after said fusible metal alloy has melted.

8. The well tool of claim 7 including a collection chamber next to said access opening for receiving melted alloy displaced from said access opening as said donor explosive is advanced into said access opening; and wherein said temperature-responsive actuator is responsive to decreasing well bore temperatures above said melting point for withdrawing said donor explosive from said access opening and into said housing means as the still-melted alloy is returned from said collection chamber to again isolate said donor explosive therein whenever said alloy is resolidified in response to temperatures below said melting point and reforms said barrier to shield said receptor explosive from the explosive force of said donor explosive before said well tool is removed from that well bore.

9. The well tool of claim 6 wherein said one explosive is said receptor explosive, said other explosive is said donor explosive; and said second means further include a temperature-responsive actuator fabricated from a shape memory metal and operable only in response to elevated well bore temperatures above said melting point for advancing said receptor explosive into said access opening and partway into said housing means for positioning said receptor explosive within detonating proximity of said donor explosive after said fusible metal alloy has melted.

10. The well tool of claim 9 including a collection chamber next to said access opening for receiving melted alloy displaced from said access opening as said receptor explosive is advanced into said access opening; and wherein said temperature-responsive actuator is responsive to decreasing well bore temperature above said melting point for withdrawing said receptor explosive from said access opening and outside of said housing means as the still-melted alloy is returned from said collection chamber to again isolate said donor explosive therein whenever said alloy is resolidified in response to temperatures below said melting point and reforms said barrier to shield said receptor explosive from the explosive force of said donor explosive before said well tool is removed from that well bore.

11. Well bore apparatus comprising:

an electrically-initiated donor explosive operable for detonating a receptor explosive in response to the explosive forces produced upon detonation of said donor explosive;

an explosion-proof housing enclosing said donor explosive for suppressing its said explosive forces, said housing including an opening for transmitting said explosive forces to the exterior of said housing, and a barrier formed of a fusible metal alloy for normally blocking the passing of said explosive forces through said opening until said alloy is melted in response to exposure to well bore fluids at a temperature greater than the melting point of said alloy; and arming means within said housing and including temperature-responsive biasing means operable only after said alloy is melted for selectively positioning said donor explosive at least adjacent to the inner end of said opening for transmitting said explosive forces through said opening to a receptor explosive positioned outside of said housing within detonating proximity of said opening.

12. The apparatus of claim 11 wherein said donor explosive is an encapsulated detonator cooperatively sized to be passed into said opening; and said temperature-responsive biasing means are operable for advancing said encapsulated detonator at least partway into said opening.

13. The apparatus of claim 11 wherein said fusible metal alloy is selected from the group consisting of binary, ternary, quaternary and quinary eutectic and non-eutectic mixtures of bismuth, lead, tin, cadmium and indium; and said alloy has a melting point lower than the anticipated temperatures of the well bore fluids at a selected well bore depth location.

14. The apparatus of claim 13 wherein said donor explosive is an encapsulated detonator cooperatively sized to be passed into said opening; and said temperature-responsive biasing means include a temperature-responsive actuator formed from a shape memory metal and operable in response to increasing well bore temperatures above said melting point for advancing said donor explosive at least partway into said opening.

15. The apparatus of claim 14 including means for collecting melted alloy displaced by advancement of said detonator into said opening; and wherein if said detonator is detonated, said temperature-responsive actuator is operable in response to deceasing well bore temperatures greater than said melting point for withdrawing said undetonated detonator from said opening for returning said melted alloy back into said opening to isolate said undetonated detonator in said housing upon resolidification of said melted alloy in response to decreasing well bore temperatures which are less than said melting point to reform said barrier for again suppressing the explosive forces of said undetonated detonator.

16. Well bore apparatus comprising:

an electrically-initiated donor explosive operable for detonating a receptor explosive in response to the explosive forces produced upon detonation of said donor explosive;

an explosion-proof housing enclosing said donor explosive for suppressing its said explosive forces, said housing including an opening for transmitting said explosive forces to the exterior of said housing, and a barrier formed of a fusible metal alloy for normally blocking said opening until said alloy is melted in response to exposure to well bore fluids at a temperature greater than the melting point of said alloy; and arming means outside of said housing adjacent to said opening and including temperature-responsive biasing means operable only after said alloy is melted for selectively positioning a receptor explosive at least adjacent to the outer end of said opening for receiving said explosive forces transmitted through said opening by said donor explosive within said housing.

17. The apparatus of claim 16 wherein said fusible metal alloy is selected from the group consisting of binary, ternary, quaternary and quinary eutectic and non-eutectic mixtures of bismuth, lead, tin, cadmium and indium; and said alloy has a melting point lower than the anticipated temperatures of the well bore fluids at a selected well bore depth location.

18. The apparatus of claim 17 wherein said biasing means include a temperature-responsive actuator formed of a shape memory metal cooperatively arranged adjacent to said opening and operable in response to increasing well bore temperatures higher than said melting point of said alloy for advancing a receptor explosive at least partway through said opening and into detonating proximity of said donor explosive in said housing.

19. The apparatus of claim 18 including means for collecting melted alloy displaced by advancement of a receptor explosive through said opening; and wherein if said donor explosive is not detonated, said temperature-responsive actuator is operable in response to decreasing well bore temperatures greater than said opening for returning said melted alloy into said opening to isolate said undetonated donor explosive within said housing upon resolidification of said melted alloy in response to decreasing well bore temperatures less than said melting point to reform said barrier for again suppressing the explosive forces of said undetonated donor explosive.

20. A perforating gun to be suspended in a well bore containing well bore fluids at elevated temperatures and comprising:

a hollow carrier;

at least one shaped charge in said hollow carrier;

means in said carrier for selectively detonating said shaped charge and including an encapsulated booster explosive, and an electrically-initiated encapsulated detonator explosive spatially disposed from said booster explosive and cooperatively arranged for detonating said booster explosive in response to explosive forces produced by firing of said detonator explosive within detonating proximity of said booster explosive;

an explosion-resistant enclosure having an access opening enclosing said detonator explosive and cooperatively arranged for positioning said access opening between said encapsulated explosives;

a normally-solid fusible metal alloy barrier blocking said access opening until said barrier is melted in response to the suspension of said perforating gun in well bore fluids having temperatures higher than the melting point of said alloy; and means operable for selectively arming said perforating gun only after said barrier has been melted for moving one of said encapsulated explosives at least partway through said access opening and into detonating proximity of the other of said encapsulated explosives.

21. The perforating gun of claim 20 wherein said fusible metal alloy is selected from the group consisting of binary, ternary, quaternary and quinary eutectic and non-eutectic mixtures of bismuth, lead, tin, cadmium and indium having a melting point lower than the well bore temperatures that said perforating gun is expected to encounter.

22. The perforating gun of claim 21 wherein said arming means include a temperature-responsive actuator fabricated from a shape memory metal responsive to increasing well bore temperatures above said melting point of said alloy for advancing said one encapsulated explosive into detonating proximity of said other encapsulated explosive.

23. The perforating gun of claim 22 where said one encapsulated explosive is said electrically-initiated detonator explosive; and said temperature-responsive actuator is operable for positioning said detonator explosive at least partway in said access opening within detonating proximity of said booster explosive.

24. The perforating gun of claim 23 further including means for selectively disarming said perforating gun when said detonator explosive is not fired and including an overflow reservoir in communication with said access opening; and said temperature-responsive actuator is responsive to decreasing well bore temperatures above said melting point for withdrawing said detonator explosive through the melted alloy collected in said reservoir for returning the melted alloy back into said access opening to again isolate said unfired detonator explosive in said enclosure upon resolidification of said alloy in response to decreasing well bore temperatures less than said melting point to reform said barrier for suppressing the explosive forces of said unfired detonator explosive before said perforating gun has been removed from a well bore.

25. The perforating gun of claim 22 where said one encapsulated explosive is said booster explosive; and said temperature-responsive actuator is operable for positioning said booster explosive at least partway in said access opening in detonating proximity of said detonator explosive.

26. The perforating gun of claim 25 wherein said means for selectively detonating said shaped charge further include a second booster explosive, and a detonating cord coupled to said second booster explosive and arranged for detonating said shaped charge in response to the detonation of said encapsulated booster explosive by said detonator explosive.

27. Well bore apparatus to be installed in a well bore perforator carrying one or more shaped explosive charges and comprising:

an explosion-proof housing formed of a material of sufficient thickness for suppressing the explosive forces of an encapsulated electrically-initiated detonator disposed therein and having an opening in one end thereof coaxially arranged around the central longitudinal axis of said housing;

an encapsulated electrically-initiated detonator in said housing;

a detonator support arranged within said housing for moving said detonator along said axis between a normal position entirely within said housing and an extended position where said detonator is at least adjacent to said opening within detonating proximity of a booster outside of said housing;

a closure member is formed of a fusible metal alloy having a predetermined melting point lower than an anticipated well bore temperature cooperatively arranged in said enlarged opening for confining the explosive forces of said detonator entirely within said chamber so long as said closure member is not subjected to a well bore temperature greater than said predetermined melting point; and biasing means including a temperature-responsive actuating spring formed of a shape memory metal arranged between said housing and said detonator support for advancing said detonator to said extended position in response to increasing well bore temperatures which are greater than said predetermined melting point of said fusible metal alloy and operable in response to decreasing well bore temperatures greater than said melting point of said fusible metal alloy for returning said detonator to said normal position.

28. The apparatus of claim 27 wherein said fusible metal alloy is selected from the group consisting of binary, ternary, quaternary and quinary eutectic and non-eutectic mixtures of bismuth, lead, tin, cadmium and indium.

29. The apparatus of claim 28 wherein said biasing means further include a spring cooperatively arranged between said housing and said detonator support for augmenting the biasing force of said actuating spring for returning said detonator to said normal position.

30. Well bore apparatus to be installed in a well tool carrying one or more explosive devices and comprising:

an explosion-proof housing formed of a material of sufficient thickness for suppressing the explosive forces of an encapsulated electrically-initiated detonator disposed therein and having an opening in one end thereof coaxially arranged around the central longitudinal axis of said housing;

an encapsulated electrically-initiated detonator mounted in said housing;

a booster support for carrying a booster arranged outside of said housing for moving along said axis between a normal position away from said opening and an advanced position adjacent to said opening and within detonating proximity of said detonator;

a closure member formed of a fusible metal alloy having a predetermined melting point lower than an anticipated well bore temperature cooperatively arranged in said enlarged opening for confining the explosive forces of said detonator entirely within said housing so long as said closure member is not subjected to a well bore temperature greater than said predetermined melting point; and biasing means including a temperature-responsive actuating spring formed of a shape memory metal arranged between said housing and said booster support for advancing said support to said advanced position in response to increasing well bore temperatures which are greater than said predetermined melting point of said fusible metal alloy and operable in response to decreasing well bore temperatures greater than said melting point of said fusible metal alloy for returning said booster support to said normal position.

31. The apparatus of claim 30 wherein said fusible metal alloy is selected from the group consisting of binary, ternary, quaternary and quinary eutectic and non-eutectic mixtures of bismuth, lead, tin, cadmium and indium.

32. The apparatus of claim 31 wherein said biasing means further include a spring cooperatively arranged between said housing and said booster support for augmenting the biasing force of said actuating spring for returning said booster support to said normal position.

33. A method for performing a well service operation with a well tool having an explosive device coupled to a receptor explosive and an electrically-initiated explosive detonator for selectively detonating said receptor explosive and comprising the steps of:

mounting said detonator inside of an explosive-proof housing with an opening in one end thereof adjacent to said receptor explosive and blocking said opening with a barrier comprised of a normally-solid fusible metal alloy for suppressing the explosive forces of said detonator until said well tool is lowered into a well bore containing well bore fluids at elevated temperatures greater than the melting point of said fusible metal alloy;

lowering said well tool into a well bore for conducting a well service operation at a depth interval containing well fluids at said elevated temperatures;

delaying the initiation of said detonator until said barrier is melted by the elevated temperatures of said well bore fluids;

after said barrier has been melted to unblock said opening, positioning said detonator and receptor explosive in detonating proximity of one another; and while said detonator and said receptor explosive are in detonating proximity of one another, selectively initiating said detonator for carrying out said well service operation.

34. The method of claim 33 further including the steps of:

moving said detonator and said receptor explosive out of detonating proximity with one another if said detonator is not initiated while said well tool is in the well bore; and returning said fusible metal alloy into said opening for reforming said barrier for suppressing the explosive forces of said detonator once said fusible metal alloy is cooled below its melting point as said well tool is being withdrawn from the well bore.

35. A method for perforating a well bore with a perforating gun having an enclosed fluid-tight carrier carrying at least one shaped explosive charge coupled to an encapsulated explosive booster and an electrically-initiated encapsulated explosive detonator spatially disposed therefrom from selectively detonating said booster and comprising the steps of:

mounting said detonator inside of an explosion-proof housing with an opening in one end thereof adjacent to said booster and blocking said opening with a barrier comprised of a normally-solid fusible metal alloy for suppressing the explosive forces of said detonator until said perforating gun is lowered into a well bore containing well bore fluids at elevated temperatures greater than the melting point of said fusible metal alloy and thereby rendering said detonator temporarily ineffective for setting off said shaped explosive charge;

positioning said perforating gun in a well bore containing well fluids at elevated temperatures capable of heating said barrier to the melting point of said selected fusible metal alloy so that the liquefied fusible metal alloy will flow out of said detonation path for reliably rendering said detonator effective to set off said explosive charge when said perforating gun has been positioned at a selected depth interval in the well bore;

after said barrier has been melted to unblock said opening, positioning one of said encapsulated explosives into said opening for bringing said detonator and booster in detonating proximity of one another; and selectively initiating said detonator for carrying out said perforating operation.

36. The method of claim 35 where said one encapsulated explosive is said detonator.

37. The method of claim 35 where said one encapsulated explosive in said booster.

* * * * *